US008484772B2

(12) United States Patent
Lostal Grasa

(10) Patent No.: US 8,484,772 B2
(45) Date of Patent: Jul. 16, 2013

(54) AUTOMATIC LAVATORY-CLEANING SYSTEM

(76) Inventor: Francisco Javier Lostal Grasa, Zuera (ES)

( * ) Notice: Subject to any disclaimer, the term of this patent is extended or adjusted under 35 U.S.C. 154(b) by 0 days.

(21) Appl. No.: 13/248,142

(22) Filed: Sep. 29, 2011

(65) Prior Publication Data

US 2012/0017368 A1 Jan. 26, 2012

Related U.S. Application Data

(63) Continuation of application No. PCT/ES2010/070189, filed on Mar. 30, 2010.

(30) Foreign Application Priority Data

Apr. 2, 2009 (ES) ..... 200900904

(51) Int. Cl.
*A47K 4/00* (2006.01)

(52) U.S. Cl.
USPC ..... 4/662; 4/252.2; 4/233; 4/312; 4/DIG. 2

(58) Field of Classification Search
USPC ..... 4/662, 252.1–252.3, 233, 312, DIG. 2
See application file for complete search history.

(56) References Cited

U.S. PATENT DOCUMENTS

| | | | | |
|---|---|---|---|---|
| 2,605,478 | A | 8/1952 | Lassiter | |
| 3,869,732 | A | 3/1975 | Garvey et al. | |
| 5,090,069 | A * | 2/1992 | Decaux | 4/662 |
| 7,171,700 | B2 * | 2/2007 | Glew | 4/233 |

FOREIGN PATENT DOCUMENTS

| | | |
|---|---|---|
| FR | 2 702 788 | 9/1994 |
| WO | 95/30801 | 11/1995 |
| WO | 02/01011 | 1/2002 |
| WO | 2006/048490 | 5/2006 |

OTHER PUBLICATIONS

International Search Report issued Jun. 24, 2010 in International (PCT) Application No. PCT/ES2010/070189.

* cited by examiner

*Primary Examiner* — Tuan N Nguyen
(74) *Attorney, Agent, or Firm* — Wenderoth, Lind & Ponack, L.L.P.

(57) ABSTRACT

Automatic lavatory-cleaning system, especially for public lavatories installed in a cubicle between two side walls, and with the floor converging to a drain, based on a structure that can be moved from a first, folded position into a second position in which it is deployed over the lavatory and between the side walls, comprising a supporting structure (4) concealed in a wall of the cubicle of the lavatory (1), the structure being movable, by means of a deformable parallelogram, defining a closed space for cleaning where the lavatory (1) is located.

12 Claims, 6 Drawing Sheets

AUTOMATIC LAVATORY-CLEANING SYSTEM

This application is a Continuation of international application PCT/ES2010/070189, filed Mar. 30, 2010.

OBJECT OF THE INVENTION

The present invention, as expressed in the title of the present specification, refers to an automatic lavatory-cleaning system, being designed for automatic cleaning public toilets that are installed at a certain height from the ground cantilevered or secured to the ground, having as essential objective to perform a regular cleaning of the toilet keeping it in perfect conditions of use, without any human intervention, with manual or automatic actuation.

In this way, the sometimes unpleasant task of having to manually clean public toilets in time intervals is avoided.

Another important object is that through the proposed cleaning system the application of products is allowed in order to prevent the spread of certain diseases, such as can be, *Aureginosas pseudomonas, Staphylococcus aureus, Enterococcus hirae, Escherichia coli*, and so on.

It also has the added advantage that in the cleaning performance a cabin in which is the toilet is defined, making a three-dimensional cleaning of the entire cabin, that is, inside and outside the toilet, walls and floor.

APPLICABILITY FIELD

The present specification describes an automatic lavatory-cleaning system, being applied to clean public toilets wherein the toilet is installed at a certain height from the ground cantilevered or anchored to the ground.

Thus, it is especially applicable in those public services wherein the toilets are in a small room with no other sanitary element, such as service areas, airports, bus, train, stations etc.

Furthermore, it can also be applied in planes, trains, camping, factories, restaurants, etc.

BACKGROUND OF THE INVENTION

As is known, when using the services in establishments or public places in general, we usually find with the unpleasant situation that they are so dirt practically making them impossible to use.

In this situation the only possibility to try to maintain a proper hygiene in public toilets is through continuous cleaning, which represents a significant economic cost and, even more, when displacements must be made towards the place where they are.

Also, a major drawback is that manual cleaning task, in many cases, is a very unpleasant task given the existing dirt as a result of the actions of unscrupulous people who have not the least care for the facilities.

In addition, the dirt that can be built in public toilets can lead to the spread of certain diseases such as, *Aureginosas pseudomonas, Staphylococcus aureus, Enterococcus hirae, Escherichia coli*, etc., all of them preventable with a proper cleaning.

Thus, as is known in many public places there are several toilets, mounted cantilevered or anchored to the ground, separated by a partition, which makes the cleaning time consuming, which increases the cost of cleaning that must be carried out continuously.

In order to overcome the drawbacks of manually cleaning public toilets, means that allow performing an automatic cleaning of the same have been tried to be implemented, so that we can consider the patent documents U.S. Pat. No. 2,605,478; WO 95/30801; FR 2 74 743; U.S. Pat. No. 5,655,233; U.S. Pat. No. 4,348,776; GB 191228974 and WO 2006/048490.

Patent document U.S. Pat. No. 2,605,478 describes an apparatus for cleaning a bathroom, which is based on a rotating structure that incorporates cleaning means, said structure adapting a first vertical position leaving the toilet free and a second horizontal position on the toilet for its cleaning. This structure makes all the elements to be accessible, which is a serious drawback. There is no outside or floor and walls cleaning.

Document WO 95/30801 describes a system that on one side has a rotating panel for closing a surface and a movable armature carrying the spraying device.

Patent document FR 2744743 describes a care facility for automatic toilet cleaning, which is constituted by means adapting a first position retracted into the wall and an extended position over the toilet, dragging to that position the liquid projection means.

Document WO 2006/048490 describes a cleaning system defined by unfoldable means on the toilet, unfoldable means of which includes liquid driving ducts for pressurized cleaning.

DESCRIPTION OF THE INVENTION

The present specification describes an automatic lavatory-cleaning system, being designed for automatic cleaning public toilets that are installed at a certain height from the floor cantilevered or anchored to the ground in a receptacle bounded by two side walls and with the floor converging into a drain for exiting the liquids, system of which is based on a structure movable from a first folded position to a second unfolded position over the toilet, so that the system comprises:

- a support structure hidden in a wall of the cabin for installing the toilet, fitted with a shaft flushed with the toilet, the shaft being driven by a gear motor and carrying a belt roll-up by one end, belt of which extends at the top to a driving pulley and is attached through its other end to the moveable structure by a deformable parallelogram, and;
- a movable structure between the side walls making up the cabin, comprising:
  - a first frame rotatably coupled through one side to the support structure;
  - a second frame rotatably coupled to the first frame through the opposite side of its rotary coupling to the support structure;
  - a first pair of strips rotatably coupled through one of their ends to the support structure and, rotatably coupled through their other end to a second pair of strips being jointly connected to the second frame;
  - a pair of springs attached through one end to the support structure and through their other end to the first frame of the foldable structure;
  - a first plate integral with the first frame and a second plate integral with the second frame, and;
  - at least one spring for acting on the first frame in its folded position.

The belt roll-up on the shaft, at its other end, is fixed to the first frame, so that during its unfolding slows the sharp decline of the movable structure and maintains it in a slight decrease, and during folding the belt elevates the movable structure.

The shaft is equipped with a strip attached thereto finished at its free end in an "L" shape.

Thus, with the movable structure in its stable static folding position, the first and the second frames attached to each other remain in a parallel vertical position, the second plate integral with the second frame thus sealing the wall opening, being the first and the second frame hidden in the folded position.

Moreover, the movable structure in its extended position has the first frame in horizontal position and the second frame in vertical position defining an enclosed space by the first and second plates, in enclosed space of which the toilet is located allowing performing its tridimensional cleaning and collecting the liquids through the drain of the floor which converges against the wall, after the isolation of said wall.

The start of the operation for unfolding the movable structure is produced by the action of the springs that move and expel it from its stable static position, by acting on the first frame after releasing of the motor by rotating a security anchor, and continue its soft and progressive fall by gravity, maintaining the belt of the movable structure avoiding a sharp fall.

Moreover, in order to collaborate with the driving motor in the folding of the movable structure, the system includes a pair of springs attached through one end to the support structure and through their other end to the first frame of the movable structure.

The first pair of strips rotatably coupled by one of their ends to the support structure and rotatably coupled by their other end to the second pair of strips jointly connected to the second frame causes the movement of the first and second frames in orthogonal position between them, defining the three-dimensional cleaning space where the toilet is located.

The shaft, mounted in a position flushed with the toilet, includes a strip finished, at its free end, in an "L" shape, which in the folded position of the movable structure acts on a stud integral with the free side of the second frame of the movable structure, locking it and acting as an anti-vandal security system.

Logically, the facility will have the corresponding hydraulic system for the supply of cleaning fluids, as well as the aforementioned drainage system.

The pressure group has two solenoid, so that a first solenoid performs the flow of the toilet cleaning liquids, and a second solenoid performs the water flow to drain the own toilet.

In addition, the hydraulic system allows obtaining a significant saving of water, measurable up to 50%, and also includes a suction pump which absorbs odors avoiding the generation of the same.

Similarly, the hydraulic system incorporates a detergent and wax dispensers, as well as a thermo-fan for subsequent drying, all managed by a automaton.

To complement the description being now made, and in order to help to a better understanding of the features of the invention, a set of drawings figures of which represent in an illustrative and not limitative manner the most characteristic details of the invention, is attached to the present specification.

DESCRIPTION OF A PREFERRED EMBODIMENT

Figure 1:
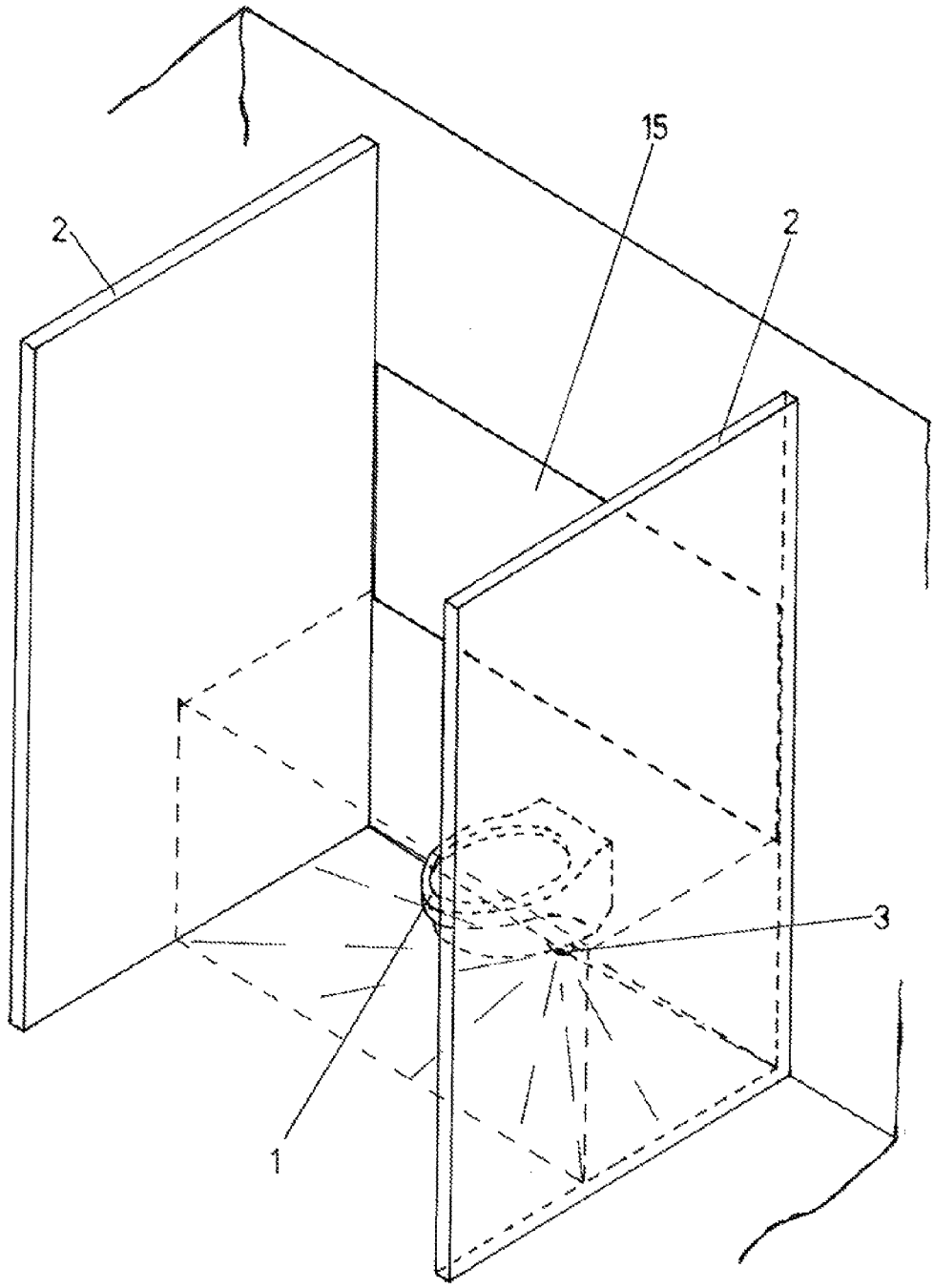
FIG. 1. Shows a perspective view of the system in its folded position. It can be seen how it is integrated into the wall out of view of users, thus maintaining a perfect aesthetic of the cabin, while the dotted line shows the unfoldable structure.

In view of the mentioned figures and according to the numbering adopted, we can see how the automatic system for toilet cleaning 1 is preferably intended to automatically clean public toilets that are installed at a certain height from the floor cantilevered or anchored to the ground in a receptacle bounded by two side walls or partitions 2 and with the floor converging to drain 3 for exiting the cleaning fluids.

The system object of the invention is based on a fixed structure, hidden in a wall, which is associated to a structure moveable, by means of a deformable parallelogram, from a first folded position, completely hidden, to a second unfolded position on the toilet 1 between the side walls of the cabin, defining an enclosed space to be cleaned, where the toilet 1 is located.

Thus, the system includes a support structure 4 which can be defined by a single pair of vertical beams hidden in one of the walls of the toilet installation 1, having in a retracted position, a shaft 5 positioned flushed with the toilet 1, said shaft 5 carrying a belt 6 that can be roll up and being driven by a motor.

The hollow shaft 5 includes the gear motor inside, as well as the control and function electronics.

A major advantage of the system object of the invention, besides being completely hidden in its folded position, is that it takes up minimal space, so that its totality can be in the space conventionally determined by the width of the toilet cistern, that is, in about 20 cm, said space being wasted.

The aforementioned belt 6, that can be roll on the shaft 5, by one of its end, extends at the top to a driving pulley 7 for being fixed at its other end to the movable structure.

The movable structure is basically formed by a first frame 8 rotatably coupled by one of its sides, to the support structure 4 and a second frame 9 rotatably coupled to the first frame 8 by the side opposite to that of the rotary coupling to the support structure 4. Thus, the first frame 8 making up the movable structure is coupled to the supporting structure 4 through shaft 10. The first and second frames are joined together by hinges 27.

The displacement means of the movable structure are based on a deformable parallelogram composed of a pair of first strips 11 rotatably coupled by one of their ends to the support structure 4 via shaft 13, and rotatably coupled by their other end to a pair of second strips 12 that are jointly connected to the second frame 9 making up the movable structure.

Thus, the movable structure is actuated by a movable parallelogram which allows adopting a first folded position with the mechanism hidden and a second unfolded position on the toilet 1 defining an enclosed space between the side walls 2 for performing the cleaning.

Moreover, in the first frame 8 a first plate 14 is integrally mounted therewith and in the second frame 9 a second plate 15 is also integrally mounted therewith, so that the plate of the second frame 9 in folded position, will be closing the cavity of the wall in which the movable structure is hidden and the same may be made up of tiles, marble or similar to the wall itself, being concealed without appreciating its existence.

In addition, the system includes at least one spring 16, preferably would be two springs existing, for acting on the first frame 8 in its folded position, which at the time to start their unfolding and after releasing the gear motor that drives the shaft 5, expels it and begins its extension, which will smoothly and progressively occur by being supported by the very belt 6 that can be roll on the shaft 5 driven by the gear motor.

When the movable structure is folded by the action of the gear motor, a pair of springs 28 that minimize the force to be exerted by the same cooperates.

The aforementioned pair of springs 29 are connected through one of their ends to a first pair of lugs 30 jointly connected to the first frame 8 and through their other end are attached to a second pair of lugs 31 jointly connected to the support structure 4.

Moreover, with the movable structure in its extended position the first frame 8 is in its horizontal position and the second frame 9 in its vertical position defining an enclosed space through the first and second plates 14 and 15, in enclosed space of which the toilet 1 is located allowing performing its three-dimensional cleaning and collecting the fluids down the drain 3 which converges against the ground, i.e. it allows performing a cleaning not only inside the toilet, but an exterior cleaning, by the abutting walls and the ground.

Thus, the tubular profiles making up the first and second frames 8 and 9, respectively, of the movable structure, includes the lines of the cleaning liquids and the diffusers 17.

At the beginning of the operation for unfolding the movable structure, the movement of the structure is produced by the action of the springs 16 acting on the first frame 8 moving and expelling it from its stable static position and performing its descent by gravity, the belt 6 with the rotation shaft 5 maintaining it for avoiding a sharp fall.

The first pair of strips 11 rotatably coupled together through one of their ends to the pair of support beams 4 and through their other end rotatably coupled together to the second pair of strings 12 jointly connected to the second frame 9 causes the displacement of the first and second frames in orthogonal position there between, defining the space for locating the toilet.

Shaft 5, mounted on a position flushed with the toilet 18 includes a strip finished in an "L" shape, which in the folded position of the movable structure acts on a stud 19 integral with the free side of the second frame 9 of the movable structure, blocking the same, acting as a security and anti-vandalism element.

FIG. 1 of the drawings shows how the foldable structure has the second plate 15 integral with the second frame 9 closing the window or cavity of the wall for hiding the system, allowing the general public practically not detecting its existence.

Logically, the facility will have the corresponding hydraulic system, which may include a fluid tank 20 coming from the shower/tub and from the sink for its recycling and further use as water drainage from the toilet and cleaning, with the substantial saving it entails, as well as the aforementioned drainage system. Into this deposit the overall water pipeline 21 can also flow.

Likewise, the hydraulic system includes a pressure pump 22 and two solenoids 23 and 24 so that through a first solenoid 23 the cleaning liquids for the toilet 1 flows, by being expelled under pressure through the diffusers 17, and a second solenoid 24 performs the flow of water for draining the toilet itself 1.

Similarly, the hydraulic system includes an odor suction pump 28 from the toilet itself using the same emptying or draining pipe thereof, when water does not fall, leading odors to outside, after passing, if appropriate, through coal filters.

In addition, the hydraulic system allows obtaining a significant saving of water, measurable up to 50%.

Similarly, the hydraulic system includes a detergent 25 and wax 26 dispensers and a thermo-fan for subsequent drying, all managed by a automaton.

Figure 2:
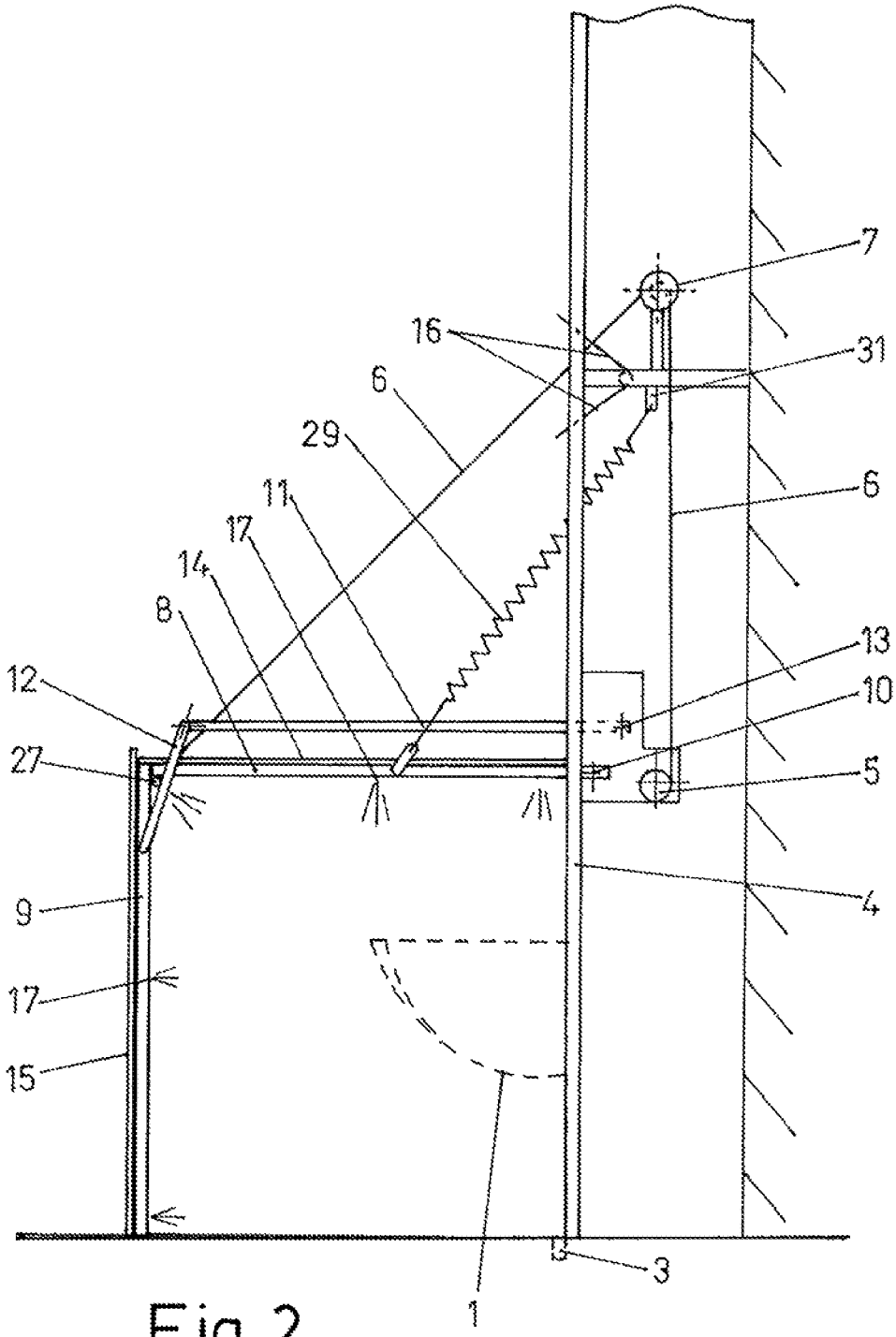
FIG. 2. Shows an elevational side view of the system in its extended position between the side walls, there can be seen how an enclosed space for cleaning is embodied.

Similarly, FIG. 2 shows how when the structure is unfolded the cleaning cabin is defined, which allows not only cleaning inside and outside the toilet 1, but cleaning the abutting walls and the floor, the cleaning fluids being driven into drain 3, so that by incorporating the cleaning water certain products will allow a perfect disinfection avoiding possible transmission of diseases.

Figure 3:
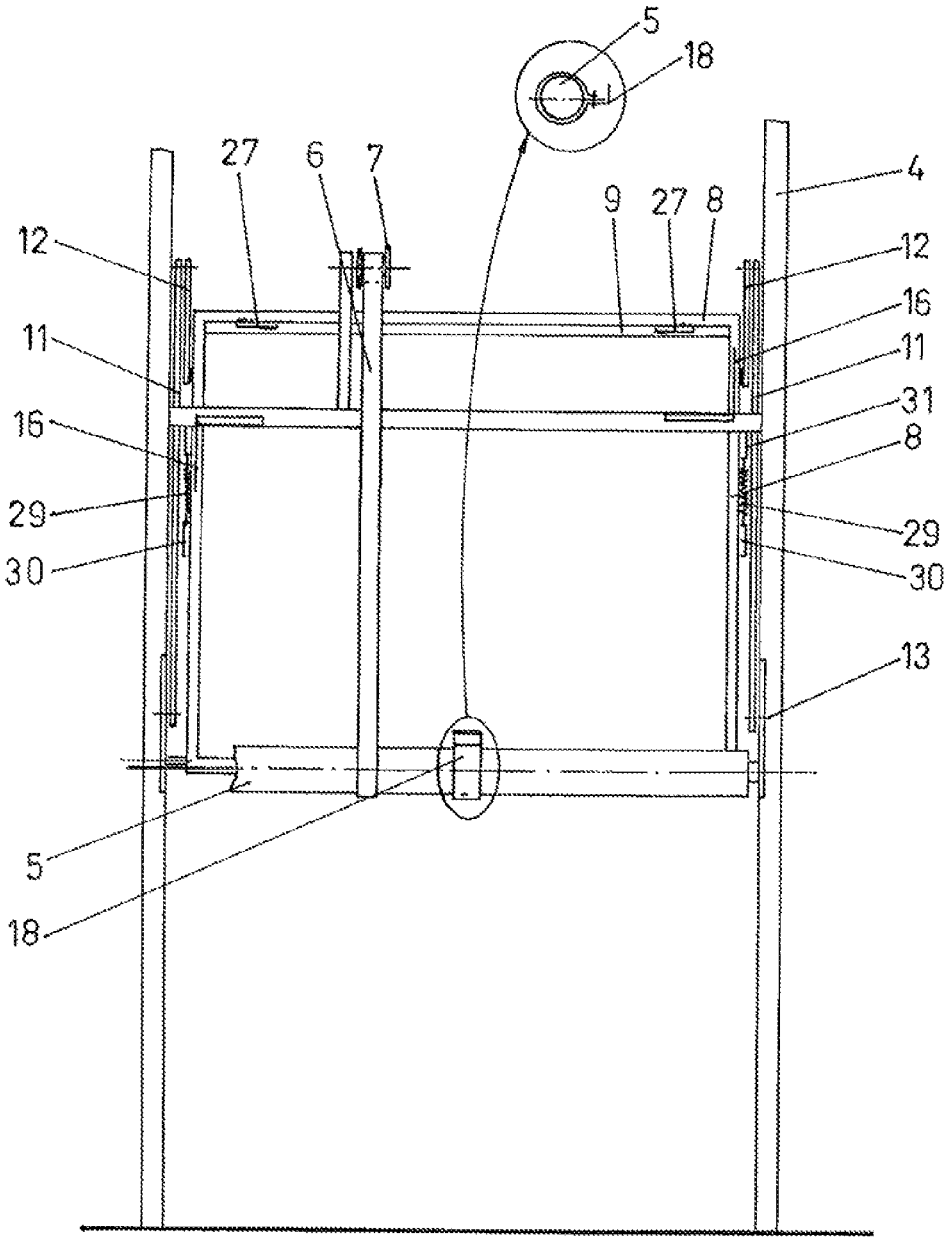
FIG. 3. Shows a rear view of the system in its folded position.

FIG. 3 shows the unfoldable structure in its folded position, having represented a detail of the strip clamping the shaft 5, and which by being finished in an "L" shape allows anchoring the stud 19 jointly connected to the second frame 9, acting as a security anti-vandal element.

Figure 4:
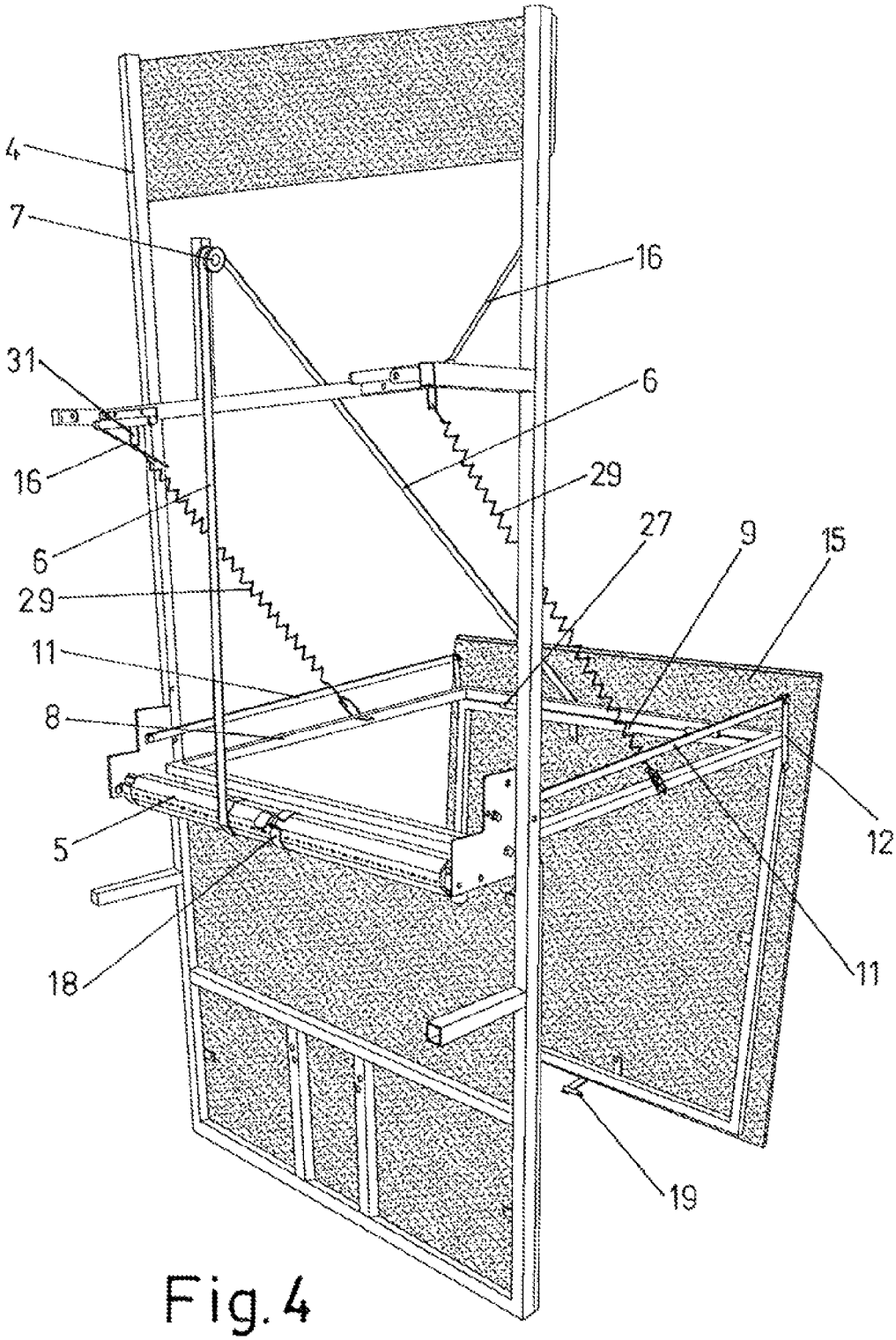
FIG. 4. Shows a perspective view of the system, according to a rear view, seeing the shaft for rolling up the belt, the lifting belt of the movable structure, the pair of springs that work with the motor and the strips for folding/unfolding the movable structure, having removed the plate from the first frame.
Figure 5:
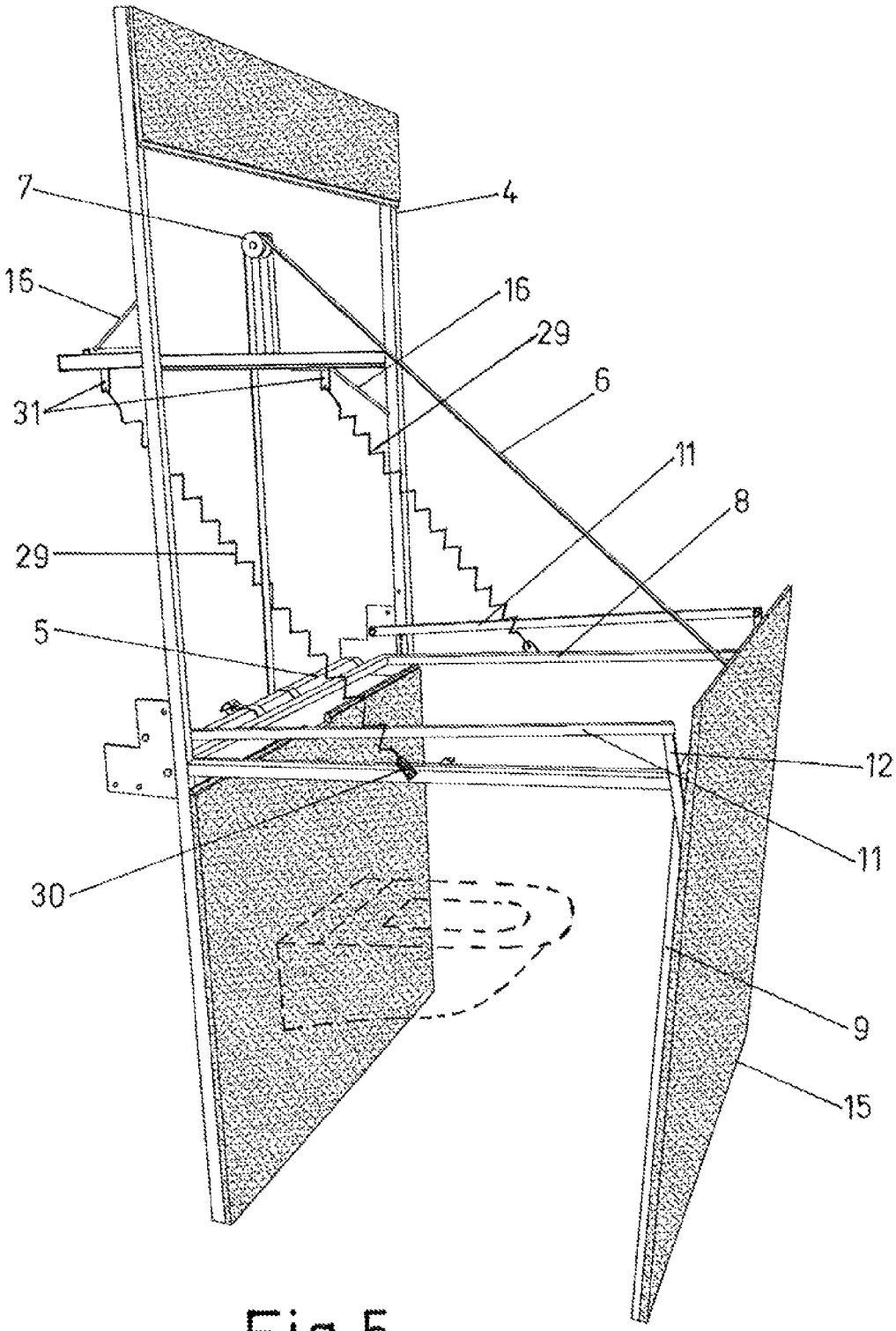
FIG. 5. Shows a second perspective view of the system in its extended position, there can be seen the strips for folding/unfolding the movable structure, having removed the plate from the first frame.
Figure 6:
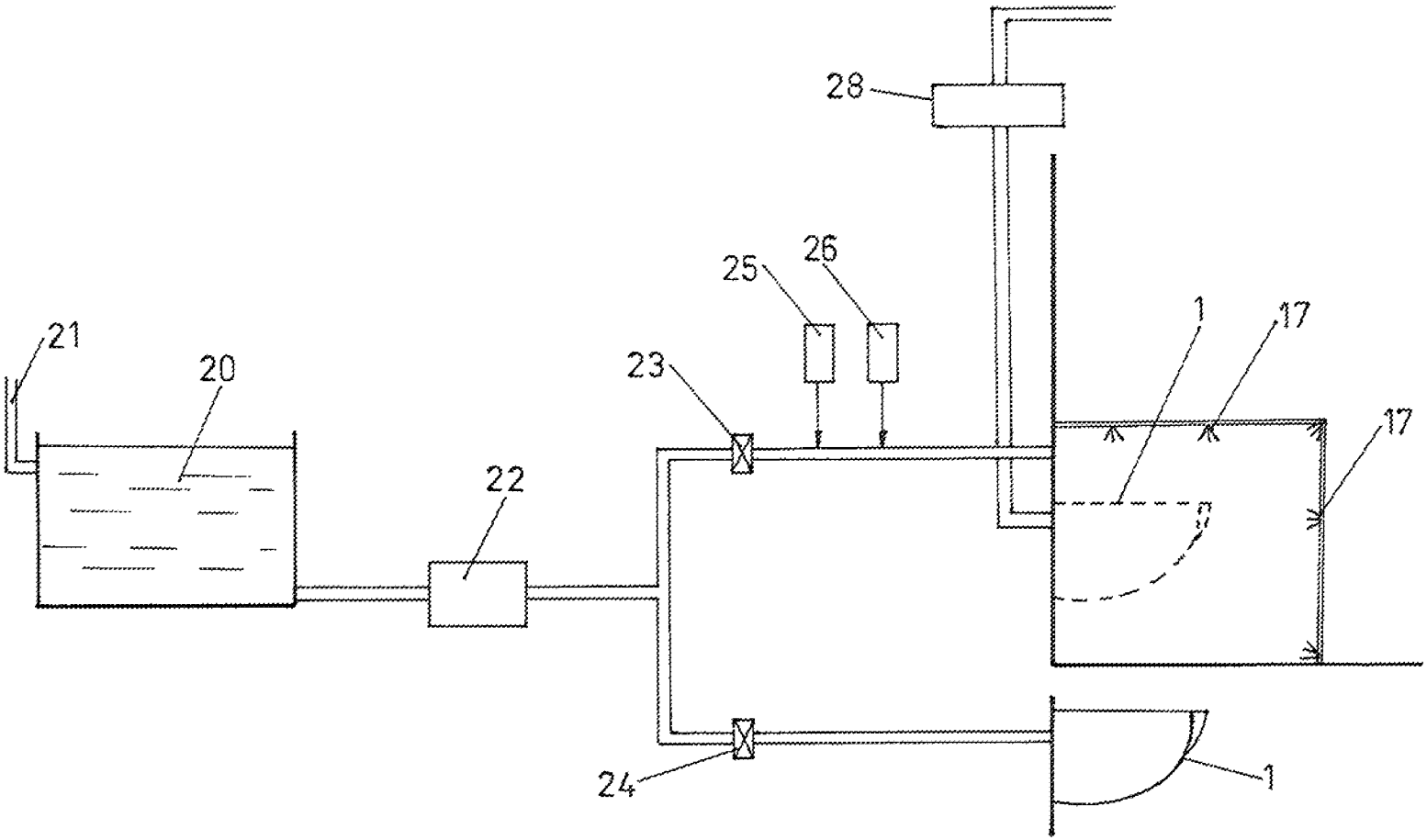
FIG. 6. Shows a view of the hydraulic system for cleaning.

FIG. 4 of the drawings shows stud 19 integral with the free side of the second frame 9, so that in the folded position is blocked by the strip 18, so that if the unfoldable structure is tried to be unfolded the block of said stud prevents it from being manually unfolded.

Furthermore, as can be seen, the first plate 14 attached to the frame 8 has been removed in order to better see the structure to be shown.

FIGS. 2 to 5 of the drawings show the pair of springs 29 positioned between the first frame 8 and the support structure 4.

An important advantage of the system is that it will automatically drain the toilet each time is used and each predetermined number of uses, for example five, when detecting that there is no presence of a user in the cabin the system will be activated for unfolding the movable structure and carrying out the cleaning inside and outside the toilet 1 and the floor and surrounding walls. To this purpose, the system will be programmed to block the access door and will be unlocked once the cleaning has been performed and the structure has returned to its folded position.

Thus, no cleaning is at the discretion of cleaning workers, but, inexcusably, takes place every a certain number of uses.

Also, one or more cabins, provided with all the necessary means for their normal functioning, as explained, can be mounted on a transportable structure, allowing its transport and temporary installation in different places, wherein the corresponding water, electricity jacks etc. would be provided.

In this way, the system mounted on a transportable structure, which is provided with the corresponding jacks of different services (water, electricity, sewage, etc.) for connection to the installation site, will be used for the development of different events, such as festivals, concerts, etc.

The invention claimed is:

1. An automatic lavatory-cleaning system comprising:

a support structure (4) hidden in a wall of a cabin for installing a toilet(1), fitted with a shaft (5) flushed with the toilet (1), the shaft (5) being driven by a gear motor, a belt (6) having a first end attached to said shaft (5) so as to be rolled up by said shaft (5), said belt (6) extending upwardly and about a driving pulley (7) and having a second end attached to a moveable structure;

the movable structure comprising a first frame (8) rotatably coupled through a first side to the support structure (4) defined by a pair of beams, a second frame (9) rotatably coupled to the first frame (8) at a second side of the first frame (8) opposite its rotary coupling to the support structure (4), a first pair of strips (11) rotatably coupled through a first end to the support structure (4) and, rotatably coupled through a second end to a second pair of strips (12) each being connected to the second frame (9) by a joint, a pair of springs (29) attached through first ends to the support structure (4) and through second ends to the first frame (8) of a foldable structure, a first plate (14) integral with the first frame (8) and a second plate (15) integral with the second frame (9), and at least one spring (16) for acting on the first frame (8) in its folded position.

2. The automatic lavatory-cleaning system, according to claim 1, wherein the belt (6) rolls on the shaft (5), and through its second end is fixed to the first frame (8) of the movable structure.

3. The automatic lavatory-cleaning system, according to claim 1, wherein the movable structure in a stable static folded position has the first frame (8) and the second frame (9) attached to each other in a vertical position, with the second plate (15) integral with the second frame (9) sealing an opening of the wall.

4. The automatic lavatory-cleaning system, according to claim 1, wherein in an extended position of the movable structure, the first frame (8) stays in a horizontal position and the second frame (9) stays in a vertical position defining a space closed by the first plate (14) and the second plate (15) locating the toilet (1).

5. The automatic lavatory-cleaning system, according to claim 1, wherein at a beginning of an operation for unfolding the movable structure, displacement and expulsion of the movable structure is caused by action of the at least one spring (16) acting on the first frame (8) by displacing said first frame (8) from a stable static position and lowering said first frame (8) by gravity supported by the belt (6), after releasing of the shaft (5) driven by the gear motor.

6. The automatic lavatory-cleaning system, according to claim 1, wherein the first pair of strips (11) are arranged to cause displacement of the first frame (8) and the second frames (9) in an orthogonal position there between defining a space for locating the toilet.

7. The automatic lavatory-cleaning system, according to claim 1, wherein the second ends of the springs (29) are joined to the foldable structure by being joined to the first frame (8) through a first pair of lugs (30) integral with the first frame (8), and the first ends of the springs (29) are joined to the support structure (4) by being joined to a second pair of lugs (31) integral with the support structure (4).

8. The automatic lavatory-cleaning system, according to claim 1, wherein the shaft (5) includes a strip (18) finished in an "L" shape, which in a folded position of the movable structure acts on a stud (19) blocking said movable structure and the shaft (5).

9. The automatic lavatory-cleaning system, according to claim 1, further comprising a hydraulic cleaning system that includes a pressure pump (22) and first and second solenoids (23 and 24), so that through the first solenoid (23) cleaning liquids for the toilet (1) flow, and the second solenoid (24) performs the flow of water for draining the toilet (1) itself.

10. The automatic lavatory-cleaning system, according to claim 9, wherein the hydraulic system includes, at least, one detergent dispenser (25) and another dispenser for waxes (26), as well as a thermo-fan for subsequent drying, all managed by an automaton.

11. The automatic lavatory-cleaning system, according to claim 9, wherein the hydraulic system includes a suction pump (28) communicated with the toilet (1).

12. The automatic lavatory-cleaning system, according to claim 1, wherein the automatic lavatory-cleaning system is mounted on a transportable structure and is provided with the corresponding jacks of different services for a connection to an installation site.

* * * * *